US005306904A

United States Patent [19]

Shimabukuro et al.

[11] Patent Number: 5,306,904

[45] Date of Patent: Apr. 26, 1994

[54] MULTILAYER MICROELECTRONIC PHOTOMULTIPLIER DEVICE WITH A STACKED SERIES OF DYNODE AND INSULATING LAYERS

[75] Inventors: Randy L. Shimabukuro; Stephen D. Russell, both of San Diego, Calif.

[73] Assignee: The United States of America as represented by the Secretary of the Navy, Washington, D.C.

[21] Appl. No.: 19,414

[22] Filed: Feb. 16, 1993

Related U.S. Application Data

[63] Continuation-in-part of Ser. No. 908,692, Jul. 1, 1992, Pat. No. 5,264,693.

[51] Int. Cl.[5] ..... H01J 39/06

[52] U.S. Cl. ..... 250/207; 313/533

[58] Field of Search ..... 250/207, 214 VT; 313/533, 103 R, 105 R, 534, 535, 536; 437/927

[56] References Cited

U.S. PATENT DOCUMENTS

| | | | |
|---|---|---|---|
| 4,094,703 | 6/1978 | Williams | 136/89 |
| 4,115,719 | 9/1978 | Cantanese et al. | 313/105 R |
| 4,147,929 | 4/1979 | Taylor | 250/207 |
| 4,148,050 | 4/1979 | Maier, Jr. | 357/30 |
| 4,534,099 | 8/1985 | Howe | 29/572 |
| 4,557,037 | 12/1985 | Hanoka et al. | 29/576 B |
| 4,758,734 | 7/1988 | Uchida et al. | 437/2 |
| 4,826,777 | 5/1989 | Ondris | 250/578 |
| 4,925,805 | 5/1990 | Van Omnen et al. | 437/927 X |
| 4,990,827 | 2/1991 | Ehrfeld et al. | 313/533 |
| 5,098,856 | 3/1992 | Beyer et al. | 437/927 X |
| 5,264,693 | 11/1993 | Shinabukuro et al. | 250/207 |

*Primary Examiner*—David C. Nelms
*Assistant Examiner*—John R. Lee
*Attorney, Agent, or Firm*—Harvey Fendelman; Thomas Glenn Keough

[57] ABSTRACT

A muitilayer microelectronic photomultiplier device is fabricated by discrete procedures to provide a photocathodeanode and dynode chain arrangement which is analogous in operation to conventional photomultiplier tubes. This multilayer microelectronic photomultiplier device provides for low level photon detection and realizes the advantages of high reliability, small size and fast response, plus lower cost, weight and power consumption compared to conventional photomultiplier tubes. In addition, the fabrication on an SOI substrate permits integration of logic and control circuitry with detectors. The insulating substrate also permits the integration of an on-chip high voltage supply and may easily be extended to a plurality of detectors with high packing densities due to the inherently stacked geometry offering improved performance and design flexibility.

35 Claims, 6 Drawing Sheets

MULTILAYER MICROELECTRONIC PHOTOMULTIPLIER DEVICE WITH A STACKED SERIES OF DYNODE AND INSULATING LAYERS

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATIONS

This application is a continuation in part of co-pending U.S. patent application entitled "Microelectronic Photomultiplier Device" by Randy L. Shimabukuro et al., U.S. Patent and Trademark application Ser. No. 07/908,692 filed Jul. 1, 1992, now U.S. Pat. No. 5,264,693.

BACKGROUND OF THE INVENTION

A large majority of light detection applications today rely on low cost, lightweight, high performance integrated circuit devices, such as, CCD's (charge coupled devices), p-i-n (p type semiconductor:insulator:n-type semiconductor) and avalanche photodiodes. However for applications which require detection of very small signals with low signal to noise ratios (SNR), the vacuum photomultiplier tube is still superior to these integrated circuit type photodetectors.

A schematic of a conventional photomultiplier is shown in FIG. 1. It consists of a photocathode (C) and a series of electrodes called "dynodes" 1–8. Each dynode is biased at a progressively higher voltage than the cathode. Typically, the voltage increase at each dynode is about 100 volts. Photons striking the photocathode generate electrons via the photoelectric effect. These electrons are accelerated by the field between electrodes and strike the surface of the first dynode with an energy equal to the accelerating voltage. Each primary electron generates several secondary electrons in the collision with the surface of the first dynode. These secondary electrons are accelerated towards the second dynode and the process is repeated. After passing through about eight stages of dynodes, the single photoelectron will have grown to a packet of $10^5$ or $10^6$ electrons. The last electrode, labeled A, is the anode which collects the electrons in the final stage. The anode signal is then fed into appropriate external signal processing electronics. Two types of photocathodes that have been used are the opaque photocathode and the semi-transparent photocathode which only partly absorb incident light and are schematically depicted in FIGS. 2 and 3, respectively. The spectral sensitivity of the photocathode is determined by its work function, therefore it is possible to choose a photocathode material to match a specific application.

Some of the disadvantages of conventional photomultipliers relative to integrated photodetectors are their large size and weight, high costs, and large power consumption. Furthermore, external electronics are normally required to obtain useful signal information. This requires additional interconnections,, which increases system complexity and reliability. As a consequence, some modern applications, e.g. remote sensing, have been prohibited.

Thus, in accordance with this inventive concept a need has been recognized for a microelectronic form of a photomultiplier tube which is designed to combine the desirable features of conventional photomultiplier tubes with the lightweight, lowpower, low-cost advantages of an integrated circuit device.

SUMMARY OF THE INVENTION

The present invention is directed to providing methods of and apparatuses for fabricating a multilayer microelectronic photomultiplier device responsive to at least one impinging wavelength. One method and apparatus embodiment responsive to at least one impinging wavelength calls for the providing of an insulating substrate for the depositing of an anode conductive layer to create an anode on the insulating substrate and the forming of a stepped configuration insulating interlayer over the anode conductive layer. A depositing of a stacked series of dynode conductive layers interleaved with insulating layers on the stepped configuration insulating interlayer provides a stacked series of dynode conductive layers interleaved with insulating layers that have a portion defining a stepped cross-sectional configuration. An etching-away of the portion defining a stepped cross-sectional configuration produces a cavity between separated columns of alternately staggered dynode conductive layers interleaved with insulating layers thereby exposing separated columns of alternately staggered dynodes and the anode. Evacuating any gas that may have been in the cavity produces an evacuated cavity so that upon the closing of the evacuated cavity with a transparent substrate having a photocathode, an evacuated cavity-chamber is created which is in communication with the photocathode, the separated columns of alternately staggered dynodes and the anode. The photocathode has the property to generate a representative electron emission in response to the at least one impinging wavelength to thereby provide the microelectronic photomultiplier device.

Another method and apparatus embodiment responsive to at least one impinging wavelength calls for the providing of an insulating substrate, for the depositing an anode conductive layer to create an anode on the insulating substrate and the forming of a first insulating interlayer over the anode conductive layer. A depositing of a stacked series of dynode conductive layers interleaved with insulating layers on the first insulating interlayer provides a stacked series of dynode conductive layers interleaved with insulating layers that have a symetrical cross-sectional configuration. An etching-away of the portion defining a symetrical configuration produces a cavity between separated columns of dynode conductive layers interleaved with insulating layers thereby exposing separated columns of dynodes and the anode to permit an evacuating of any gas that may have been in the cavity to produce an evacuated cavity so that upon the closing of the evacuated cavity with a transparent substrate having a photocathode thereon creates an evacuated cavity-chamber. The cavity-chamber is in communication with the photocathode, the separated columns of dynodes and the anode. The photocathode has the property to generate a representative electron emission in response to the at least one impinging wavelength to thereby provide the microelectronic photomultiplier device.

An object of the invention is to provide a photomultiplier device which is in thin film microelectronic form to gain all the advantages typical of microelectronics.

Another object is to provide a microelectronic photomultiplier device being smaller in size, lower in cost, more reliable, less in weight and with less power consumption as compared to a conventional photomultiplier tube.

Another object of the invention is to provide a microelectronic photomultiplier fabricated in an SOI type technology which is compatible with microelectronic circuits to allow logic and control circuitry to be integrated with the photomultiplier detectors.

Yet another object of the invention is to provide a microelectronic photomultiplier capable of being fabricated in an integrated circuit configuration to allow the device to be integrated with high voltage power supplies.

Another object is to provide a microelectronic photomultiplier capable of being fabricated in a plurality of detectors to offer improved performance and design flexibility.

Yet another object is to provide a microelectronic photomultiplier being of small size to result in faster photoresponse characteristics as compared to traditional photomultiplier tubes.

Another object is to provide a vertical structure compatible with dense packing of a plurality of devices.

These and other objects of the invention will become more readily apparent from the ensuing specification and claims when taken in conjunction with the appended drawings.

BRIEF DESCRIPTION OF THE DRAWINGS

FIGS. 5A through 5G depict a method of fabricating another embodiment of a multilayer microelectronic photomultiplier device.

DISCLOSURE OF THE PREFERRED EMBODIMENT

Figure 1:
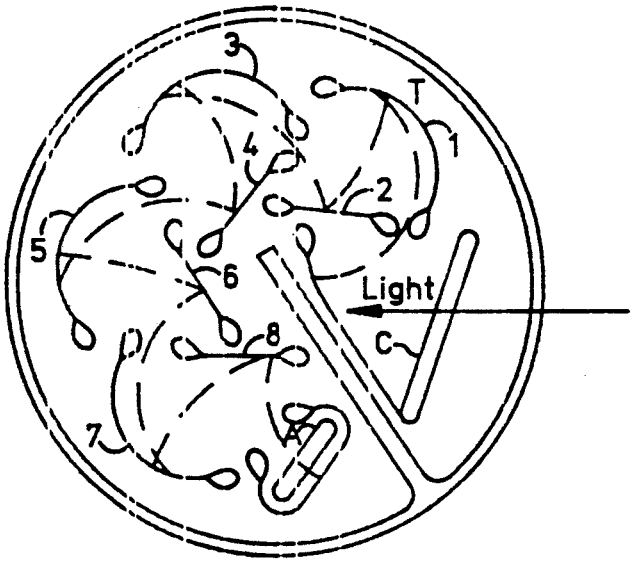
PRIOR ART FIG. 1
FIG. 1 depicts a conventional prior art photomultiplier tube.

The multilayer microelectronic photomultiplier device of this inventive concept is a low level photon detector using a photocathode, anode and dynode chain arrangement. Operation of the multilayer microelectronic photomultiplier device is analogous to the operation of a conventional photomultiplier tube as referred to above. Photons striking the photocathode generate electrons, an electron emission, via the photoelectric effect. These electrons are accelerated by the field between electrodes and strike the surface of a first dynode with an energy equal to the accelerating voltage. Each primary electron generates several secondary electrons in the collision with the surface of the first dynode. These secondary electrons are accelerated towards a second dynode and the process is repeated in a series of or stages of dynodes until where the electrons are collected at an anode. Each dynode in the series is biased at a progressively higher voltage than the cathode. Typically, the voltage increase (bias) at each dynode is about 100 volts. Thus, each dynode has the property to amplify the electron emission with a progressively increased applied voltage bias and the anode has the property to collect the amplified electron emissions.

After passing through about eight-stages of dynodes, the single photoelectron will have grown to a packet of $10^5$ or $10^6$ electrons. The last electrode is the anode which collects the amplified electron emission in the final stage. The anode signal is then fed into appropriate signal processing electronics which, in this inventive concept can be integrated on-chip.

The spectral sensitivity of the photocathode is determined by its work function, therefore it is possible to choose a photocathode material to match a specific application. The spread in transit time for a photomultiplier can be approximated by the expression:

$$\Delta t_n = -(2mW_n/e^2E_0^2)^{\frac{1}{2}},$$

where m = the mass of an electron, e = the charge of an electron, $E_0$ = the electric field strength, and $W_n$ = the energy component normal to the cathode.

A microelectronic photomultiplier in accordance with this inventive concept will operate at significantly higher ranges of $E_0$ due to the reduced size of its components. The smaller spread in transit time will yield a faster device. The microelectronic embodiment of this inventive concept additionally possesses the advantages of higher reliability and smaller size as compared to the conventional photomultiplier tube.

Additional advantageous features of this inventive concept are that the fabrication on an SOI substrate permits integration of logic, control circuitry and signal processing with the detectors. Such an arrangement on an insulating substrate also allows for the integration of an on-chip high voltage supply and lends itself to the fabrication of a plurality of detectors with high packing density due to the vertical nature of the multilayer device. This provides still greater improvements in performance and design flexibility.

This inventive concept is better appreciated from several ensuing fabrication techniques which provide all and more of the capabilities of the conventional photomultiplier tube as shown in FIG. 1.

Figure 2:
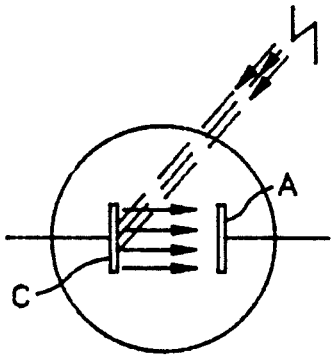
PRIOR ART FIG. 2
FIG. 2 shows a prior art opaque photocathode.
Figure 3:
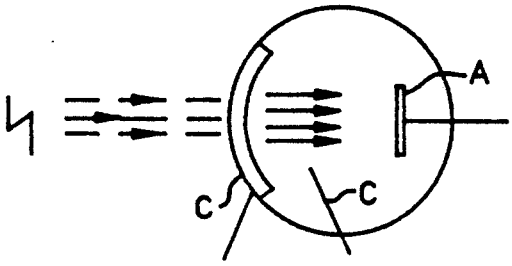
PRIOR ART FIG. 3
FIG. 3 depicts a prior art semitransparent photocathode.

The methods for fabricating the multilayer microelectronic photomultiplier device can embrace the two types of photocathodes shown in FIGS. 2 and 3, which are for the partial absorption of incident light in the semi-transparent photocathode variety and the more complete absorption of incident light in the opaque photocathode, respectively.

A preferred embodiment is set forth in FIGS. 4A through 4J that depicts a multilayer microelectronic photomultiplier device 40 begining its evolution of manufacture with the providing of an insulating substrate 41. The substrate may be fused quartz, glass, sapphire or other materials amenable with the following described fabrication steps. If desired, electronic circuitry, including biasing and additional processing components already may be fabricated on adjacent portions of the substrate and may include thin film transistors or CMOS/SOS, for example.

Figure 4A:
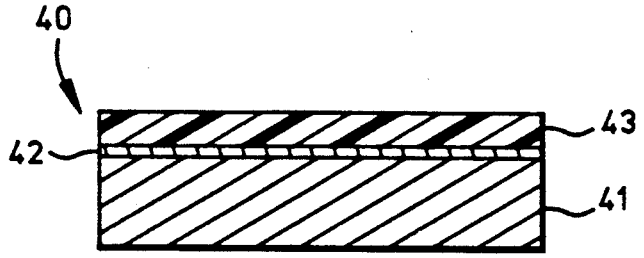
FIGS. 4A through 4J depict a method of fabricating an embodiment of a multilayer microelectronic photomultiplier device.
Figure 4B:
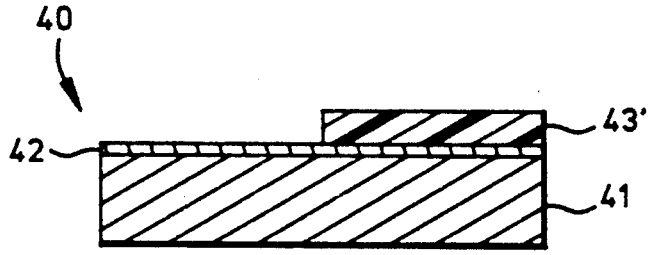

Looking now to FIG. 4A, an anode 42 is deposited on insulating substrate 41. The anode may be any one of a variety of conductive layers, such as aluminum, which has an insulating layer 43 deposited over it. The insulating layer, for example silicon dioxide or silicon nitride, is photolithographically patterned and etched to form an insulating offset 431 as shown in FIG. 4B.

The height of this offset is determined by device design parameters such as operating voltage and dielectric breakdown values, and can be readily modified in accordance with this inventive concept by those skilled in the art to which this invention pertains to achieve desired operational characteristics. In one embodiment the insulating offset (on one side of a cavity to be formed) is thinned by an amount equal to one-half the desired dynode spacing.

Figure 4C:
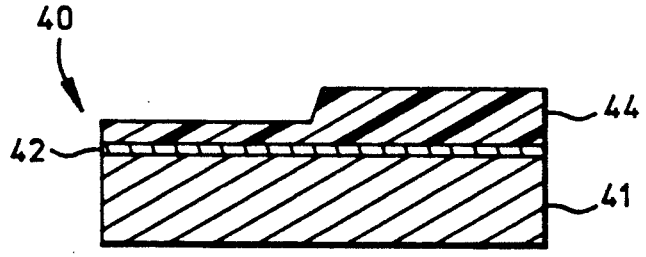
Figure 4D:
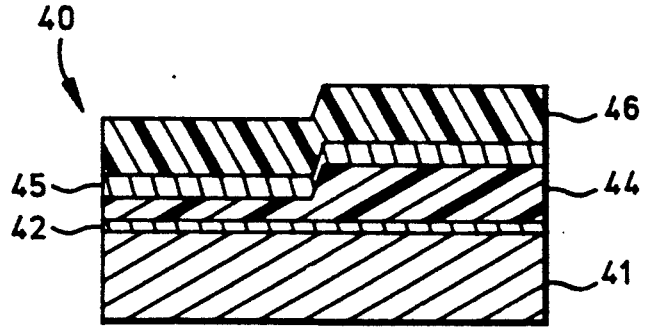
Figure 4E:
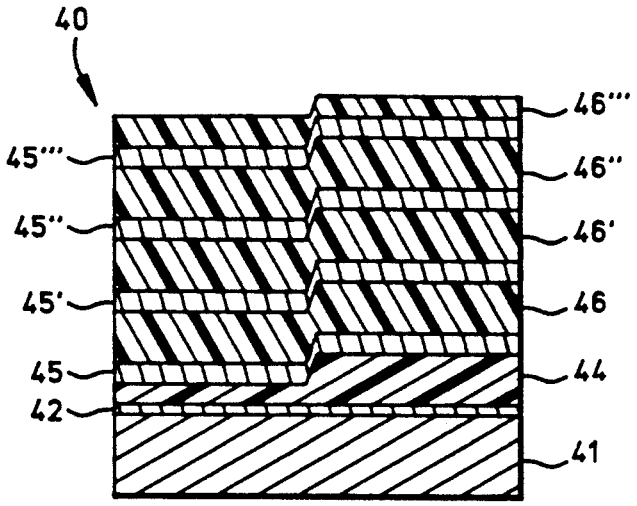

More insulating material is deposited onto insulating offset 43' and an otherwise exposed portion of anode 42 to form an insulating interlayer 44 having a stepped configuration, note FIG. 4C. This allows the deposition of another conductive layer 45, such as aluminum, onto insulating interlayer 44 and a subsequent deposition of another insulating layer 46 onto conductive layer 45 as depicted in FIG. 4D. The conductive layer 45-insulating layer 46 deposition procedure is repeated as many times as desired to form a paired conductive-layer-insulating-layer multilayer structure made up of layers 45' and 46', 45'' and 46'', 45''' and 46''', etc., which may be required for a suitable dynode chain having a desired number of stages for a desired electron multiplication, see FIG. 4E.

The paired multilayered structure is deposited or otherwise constructed to present a stacked series of dynode conductive layers that are interleaved with insulating layers from the anode insulating layer up. The stacked series of dynode conductive layers and interleaved insulating layers have a portion that defines a stepped cross-sectional configuration.

Figure 4F:
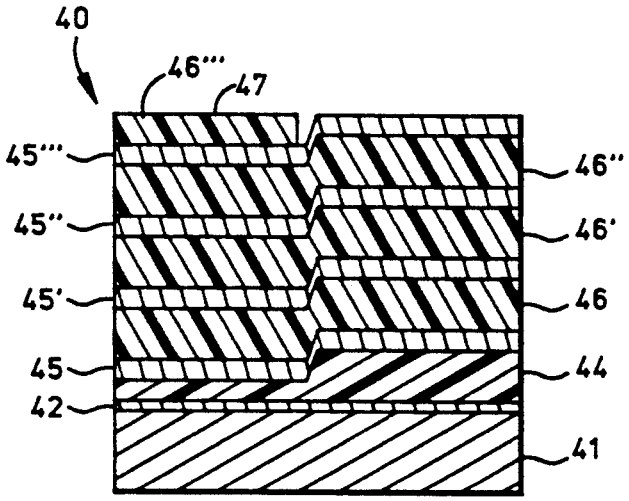

As shown in FIG. 4F, top insulating layer 46''' is etched to planarize a top surface 47 of insulating layer 46''' with the top surface of top conductive layer 45'''. When this condition has been reached, a suitable insulating material is subsequently deposited to form a planarized insulating layer 48, note FIG. 4G.

Figure 4G:
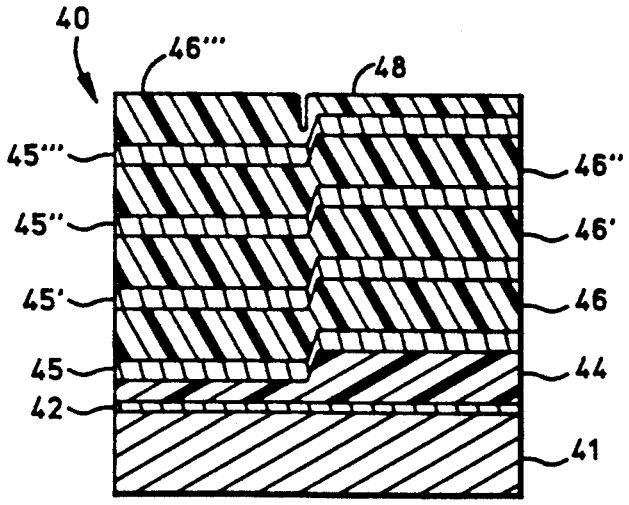
Figure 4H:
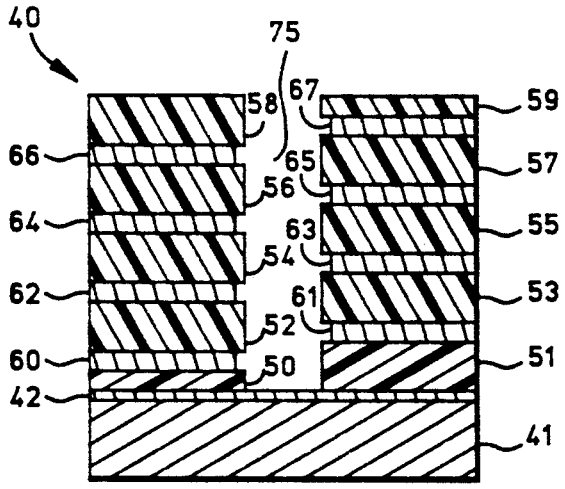

The structure of FIG. 4G is subjected to a photolithographical patterning and subsequent etching-away of the portion of insulating interlayers and conductive layers that defines the stepped cross-sectional configuration to produce the dynode structure shown in FIG. 4H. Isotropically etching the conductive layers is desired to slightly undercut the insulating interlayers to form the desired dynode, while anisotropically etching the insulating layers will form the vertical barriers desired for dielectric isolation.

The etched-away structure of FIG. 4H now has alternately staggered dynodes 60, 61, 62, . . . , 67 and insulating spacers 50, 51, 52, . . . , 59 exposed in and in communication with a cavity 75 between separated columns of alternately staggered dynode conductive layers interleaved with insulating layers. Finishing the fabrication of microelectronic photomultiplier device 40 can be in accordance with a variety of techniques, two of which will be described.

Figure 4I:
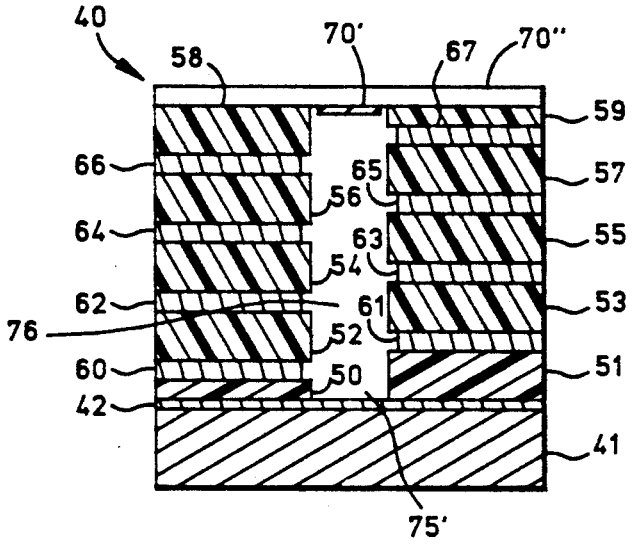

Looking to FIG. 4I, an appropriate photocathode material 70' is deposited and patterned onto a transparent substrate 70'', for example, glass, fused silica or sapphire. The resultant top portion consisting of photocathode 70' and transparent substrate 70'' is placed in intimate contact with the top surfaces of insulating spacers 58 and 59 and across cavity 75 in an evacuated ambient to effect a bonding between transparent substrate 70'' and the spacers 58 and 59. This seals a suitable vacuum in cavity-chamber 75''. The top substrate may be affixed bottom substrate using an epoxy, metallic eutectic for diffusion bonding or other suitable bonding agent.

Alternately, a wafer bonding technique can be chosen, in which case, the substrates and the spacers are appropriately matched materials, such as silicon-silicon dioxide, silicon dioxide-silicon dioxide, silicon-sapphire that are joined together by placing clean, flat surfaces of the substrates and the spacers in intimate contact. This intimate contact of the suitable materials allows van der Walls forces to join the surfaces thereby providing a permanent fusing of the two substrates via the spacers.

A subsequent heat treatment may be desired to increase the bond strength according to established practices in the art. Such bonding methods allow the use of a photocathode material which is not compatible with conventional semiconductor fabrication steps.

The photocathode material may be chosen to optimize the light collecting efficiency of multilayer microelectronic photomultiplier device 40 yet it need not be compatible with conventional microelectronic fabrication steps and devices due to the ensuing novel fabrication process.

Typical representative photocathode materials used in the prior art for photomultiplier tubes are listed in Table 1 and may be selected as applicable to the embodiments discussed herein.

TABLE 1

Standard Photocathodes for photomultipliers and vacuum photodiodes, and their characteristics

| Spectral Response Designation | Photosensitive Material | Type of Sensor | Window Material | Mode* of Operation T or R | Wavelength of Maximum Response ($\lambda_{max}$) - nm | Typical Luminous Responsivity - $\mu A\ lm^{-1}$ | Typical Radiant Responsivity at $\lambda_{max}$ - mA W | Typical Quantum Efficiency at $\lambda_{mx}$ - % | Photocathode Dark Emission at 25° C. - fA $cm^{-2}$ |
|---|---|---|---|---|---|---|---|---|---|
| S-1 | Ag—O—Cs | Photoemitter | Lime Glass | T,R | 800 | 30 | 2.8 | 0.43 | 900 |
| S-3 | Ag—O—Rb | Photoemitter | Lime Glass | R | 420 | 6.5 | 1.8 | 0.53 | — |
| S-4 | Cs—Sb | Photoemitter | Lime Glass | R | 400 | 40 | 40 | 12.4 | 0.2 |
| S-5 | Cs—Sb | Photoemitter | 9741 Glass | R | 340 | 40 | 50 | 18.2 | 0.3 |
| S-8 | Cs—Bi | Photoemitter | Lime Glass | R | 365 | 3 | 2.3 | 0.78 | 0.13 |
| S-9 | Cs—Sb | Photoemitter | 7052 Glass | T | 480 | 30 | 20.5 | 5.3 | 0.3 |
| S-10 | Ag—Bi—O—Cs | Photoemitter | Lime Glass | T | 450 | 40 | 20 | 5.5 | 70 |
| S-11 | Cs—Sb | Photoemitter | Lime Glass | T | 440 | 70 | 56 | 15.7 | 3 |
| S-13 | Cs—Sb | Photo- | Fused | T | 440 | 60 | 48 | 13.5 | 4 |

TABLE 1-continued

| Spectral Response Designation | Photosensitive Material | Type of Sensor | Window Material | Mode* of Operation T or R | Wavelength of Maximum Response ($\lambda_{max}$) - nm | Typical Luminous Responsivity - $\mu A\ lm^{-1}$ | Typical Radiant Responsivity at $\lambda_{max}$ - mA W | Typical Quantum Efficiency at $\lambda_{mx}$ - % | Photocathode Dark Emission at 25° C. - fA $cm^{-2}$ |
|---|---|---|---|---|---|---|---|---|---|
| | | Standard Photocathodes for photomultipliers and vacuum photodiodes, and their characteristics | | | | | | | |
| | | emitter | Silica | | | | | | |
| S-14 | Ge | P-n Alloy Junction | Lime Glass | — | 1,500 | 12,4000▲ | 520▲ | 43▲ | — |
| S-16 | CdSe | Polycrystalline Photoconductor | Lime Glass | — | 730 | — | — | — | — |
| S-17 | Cs—Sb | Photoemitter with Reflective Substrate | Lime Glass | R | 490 | 125 | 83 | 21 | 1.2 |
| S-19 | Cs—Sb | Photoemitter | Fused Silica | R | 330 | 40 | 65 | 24.4 | 0.3 |
| S-20 | Na—K—Cs—Sb | Photoemitter | Lime Glass | T | 420 | 150 | 64 | 18.8 | 0.3 |
| ↑ | Na—K—Cs—Sb | Photoemitter with Reflective Substrate | Lime Glass | R | 530 | 300 | 89 | 20.8 | — |
| Not Standardized | | | | | | | | | |
| ↓ | Na—K—Cs—Sb (ERMA) III) | Photoemitter | 7740 Pyrex | T | 565 | 230 | 45 | 10 | 1.4 |
| S-21 | Cs—Sb | Photoemitter | 9741 Glass | T | 440 | 30 | 23.5 | 6.6 | 4 |
| S-23 | Rb—Te | Photoemitter | Fused Silica | T | 240 | — | 4 | 2 | 0.001 |
| S-24 | K—Na—Sb | Photoemitter | 7056 Glass | T | 380 | 45 | 67 | 21.8 | 0.0003 |
| S-25 | Na—K—Cs—Sb | Photoemitter | Lime Glass | T | 420 | 200 | 43 | 12.7 | 1 — |
| ↑ | K—Cs—Sb | Photoemitter | Lime Glass | T | 380 | 85 | 97 | 31 | 0.02 |
| Not | K—Cs—Sb | Photoemitter | Lime Glass | R | 400 | 65 | 54 | 17 | — |
| standardized | Cs—Te | Photoemitter | Fused Silica | T | 250 | — | 15 | 7.4 | — |
| ↓ | | | | | | | | | |
| ↑ | Ga—As | Photoemitter | 9741 Glass | R | 830 | 300 | 68 | 10 | 0.1 |
| Not | Ga—As—P | Photoemitter | 9741 Glass | R | 400 | 160 | 45 | 14 | 0.01 |
| standardized | Ga—In—As | Photoemitter | 9741 Glass | R | 400 | 100 | 57 | 17.6 | — |
| ↓ | Cd—S | Polycrystalline Photoconductor | Lime Glass | — | 510 | — | — | — | — |
| | Cd(S—Se) | Polycrystalline Photoconductor | Lime Glass | — | 615 | — | — | — | — |
| | Si | N-on-p Photovoltaic | No Window | — | 860 | 7,650● | 580● | 83.5● | — |
| | Si | P-i-n Photoconductor | Lime Glass | — | 900# | 620# | 620# | 85# | — |

*T = Transmission Mode
R = Reflection Mode
●Photovoltaic short-circuit responsivity
#For a wafer thickness of approximately 150 μm It is to be understood that the aforementioned fabrication steps also may include patterning of the conductive and/or insulating layers to provide interconnections as required for the job at hand. The aforementioned deposition steps may also include planarization of the layers by techniques familiar to those skilled in the art. Thus the microelectronic photomultiplier device is provided with an anode 42, alternately staggered dynodes 60, 61, . . . , 67 and photocathode 70' in the vacuum cavity-chamber 75' to assure electron transport and amplification.

Another variation of this inventive concept takes the structure fabricated and depicted in FIG. 4H and fills cavity 75 with a sacrificial material 76. When using silicon nitride as the interdynode dielectric, a suitable sacrificial material is silicon dioxide. This choice of materials allows the sacrificial oxide to be etched with hydrofluoric acid without effecting the silicon nitride, polysilicon or silicon layers. The etching technique relied upon could be dry etching techniques including ion milling, plasma etching or reactive ion etching as well as others. The transparent substrate 70" with photocathode 70' is affixed appropriately. A subsequent etching-away of sacrificial material 76 forms a cavity 75 which is then sealed under vacuum to create a cavity-chamber 75'.

Figure 4J:
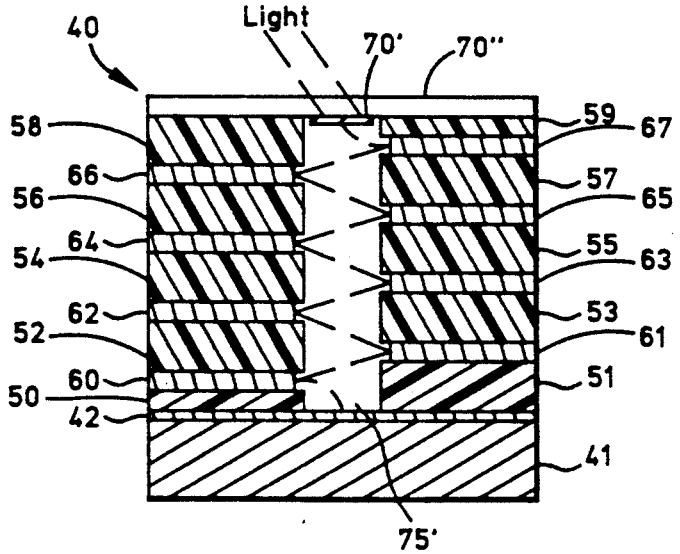

Irrespective which of the foregoing variations in the fabrication procedure are selected, a finished microelectronic photomultiplier device 40 as shown in FIG. 4J is created. This device is responsive to an appropriate wavelength of light impinging on photocathode 70' to generate a subsequent electron transport and amplification in vacuum cavity-chamber 75' along the dynode chain.

The optimum thicknesses or lengths (measured in the direction of current flow between cathode and anode) for photocathode 70 and dynodes 60 . . . 67 will depend upon the material used and upon the desired detection wavelength but shall be in the range from 1 nm to less than 500 microns. Their widths (measured in the direction perpendicular to current flow between cathode and anode) shall be more than twice their lengths. The spacing between an adjacent photocathode, alternately staggered dynodes and/or anode is in the range of from 1 nanometer to about 10 millimeters.

Further optimized designs for specific applications including additional focusing electrodes, symetrical or asymmetrical dynode configurations to improve quantum efficiency, to optimize high gain or high speed are readily accommodated within the scope of this inventive concept. When a symetrical disposition of the dynodes is selected for the last embodiment, the aforedescribed stepped-configuration insulating interlayer is at a zero thickness thereby arriving at a planar geometry on which the interleaved conductive layers and insulating layers are stacked.

Another embodiment is set forth in FIGS. 5A through 5J. A multilayer microelectronic photomultiplier device 140 begins its evolution of manufacture with the providing of an insulating substrate 141. The substrate may be fused quartz, glass, sapphire or other materials amenable with the following described fabrication steps. If desired, electronic circuitry, including biasing and additional processing components already may be fabricated on adjacent portions of the substrate and may include thin film transistors or CMOS/SOS.

Figure 5A:
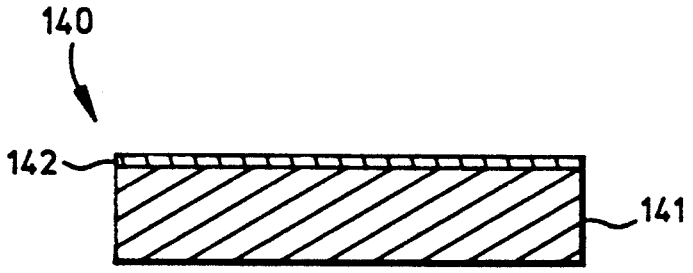
Figure 5B:
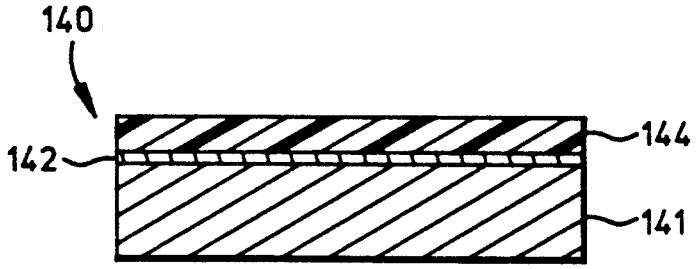
Figure 5C:
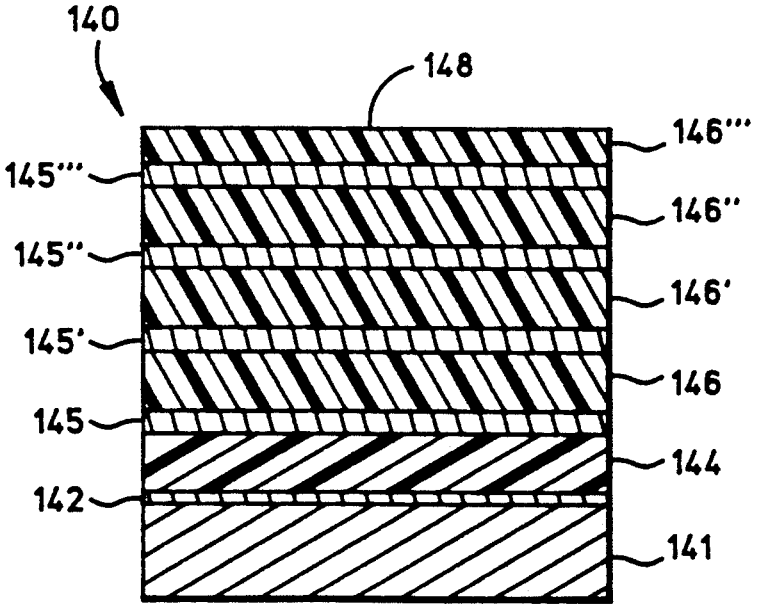

Looking now to FIG. 5A an anode 142 is deposited on insulating substrate 141. The anode may be any one of a variety of conductive layers, such as aluminum, which has an insulating layer 144 deposited over it. The insulating layer, for example silicon dioxide or silicon nitride, is not photolithographically patterned and etched to form an insulating offset in contrast to the first embodiment, see FIG. 5B. This provides a symmetrical and planar structure. This allows the deposition of another conductive layer 145, such as aluminum, onto insulating interlayer 144 and a subsequent deposition of another insulating layer 146 onto conductive layer 145. The conductive layer 145-insulating layer 146 deposition procedure is repeated as many times as desired to form a paired conductive-layer-insulating-layer multilayer structure made up of layers 145' and 146', 145" and 1464' 145''' and 146''', etc., which may be required for a suitable dynode chain for a desired electron multiplication, as depicted in FIG. 5C. The paired multilayered structure is deposited or otherwise constructed to present a stacked series of dynode conductive layers that are interleaved with insulating layers from the anode insulating layer up.

Also shown in FIG. 5C, the top insulating layer 146''' forms a planarized surface 148.

Figure 5D:
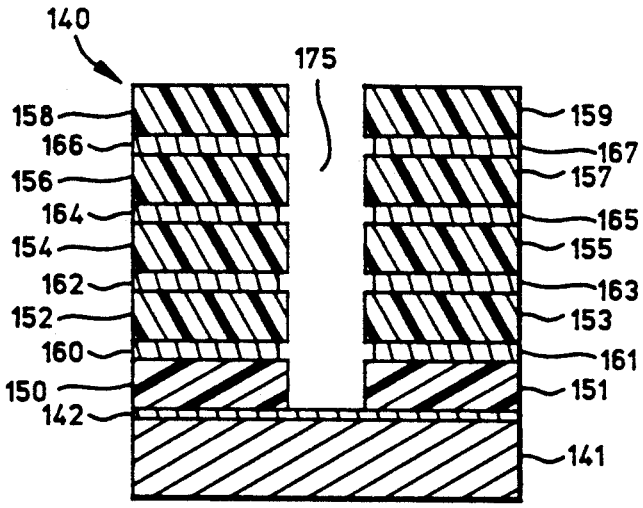
Figure 5E:
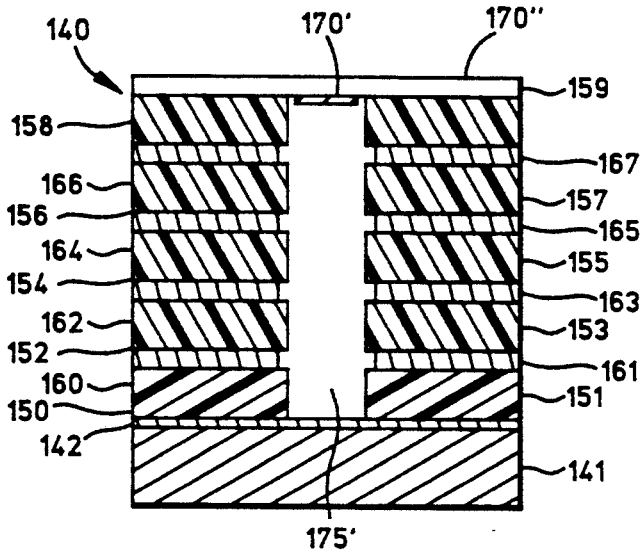

The structure of FIG. 5C is subjected to a photolithographical patterning and subsequent etching-away of the portion of insulating interlayers and conductive layers to produce the dynode structure shown in FIG. 5D. Isotropically etching the conductive layers is desired to slightly undercut the insulating interlayers to form the desired dynode, while anisotropically etching the insulating layers will form the vertical barriers desired for dielectric isolation. The etched-away structure of FIG. 5D now has interleaved dynodes 160, 161, 162, . . . , 167 and insulating spacers 150, 151, 152, . . . , 159 exposed in and in communication with a cavity 175 between separated columns of paired dynode conductive layers interleaved with insulating layers.

Finishing the fabrication of microelectronic photomultiplier device 140 can be in accordance with a variety of techniques, two of which will be described. Looking to FIG. 5E an appropriate photocathode material 170' is deposited and patterned onto a transparent substrate 170", for example, glass, fused silica or sapphire. The resultant top portion consisting of photocathode 1701 and transparent substrate 170" is placed in intimate contact with the top surfaces of insulating spacers 158 and 159 and across cavity 175 in an evacuated ambient to effect a bonding between transparent substrate 170" and the spacers 158 and 159. This seals a suitable vacuum in cavity-chamber 175'. The top substrate may be affixed bottom substrate using an epoxy, metallic eutectic for diffusion bonding or other suitable bonding agent. Alternately, a wafer bonding technique can be chosen, in which case, the substrates and the spacers are appropriately matched materials, such as silicon-silicon dioxide, silicon dioxide-silicon dioxide, silicon-sapphire that are joined together by placing clean, flat surfaces of the substrates and the spacers in intimate contact. This intimate contact of the suitable materials allows van der Walls forces to adjoin the surfaces providing a permanent fusing of the two substrates via the spacers. A subsequent heat treatment may be desired to increase the bond strength according to established practices in the art. Such bonding methods allow the use of a photocathode material which is not compatible with conventional semiconductor fabrication steps. The photocathode material may be chosen to optimize the light collecting efficiency of multilayer microelectronic photomultiplier device 140 yet it need not be compatible with conventional microelectronic fabrication steps and devices due to the ensuing novel fabrication process. Typical representative photocathode materials used in the prior art for photomultiplier tubes are listed in Table 1 and may be selected as applicable to the embodiments discussed herein.

It is to be understood that the aforementioned fabrication steps also may include patterning of the conductive and/or insulating layers to provide interconnections as required for the job at hand. The aforementioned deposition steps may also include planarization of the layers by techniques familiar to those skilled in the art. Thus the multilayer microelectronic photomultiplier device is provided with an anode 142, alternately paired dynodes 160, 161, . . . ,167 and photocathode 170' in the vacuum cavity-chamber 1751 to assure electron transport and amplification.

Another variation of this inventive concept takes the structure fabricated and depicted in FIG. 5D and fills cavity 175 with a sacrificial material 176. When using silicon nitride as the interdynode dielectric, a suitable sacrificial material is silicon dioxide. This choice of materials allows the sacrificial oxide to be etched with hydrofluoric acid without effecting the silicon nitride, polysilicon or silicon layers. The etching technique relied upon could be dry etching techniques including ion milling, plasma etching or reactive ion etching as well as others. The transparent substrate 17011 with photocathode 170' is affixed appropriately. A subsequent etching-away of sacrificial material 176 forms a cavity 175 which is then sealed under vacuum to create a cavity-chamber 175'.

Figure 5F:
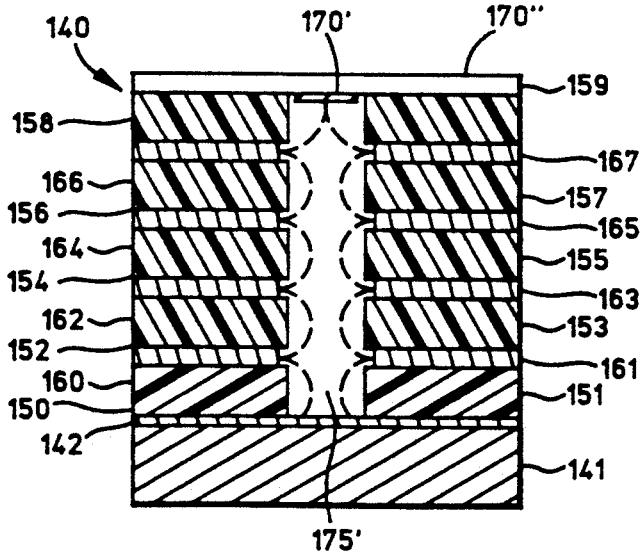

Irrespective which of the foregoing variations in the fabrication procedure are selected, a finished microelectronic photomultiplier device 140 as shown in FIG. 5F is created. This device is responsive to an appropriate wavelength of light impinging on photocathode 170' to generate a subsequent electron transport and amplification in vacuum cavity-chamber 175' along the dynode chain.

The optimum thicknesses or lengths (measured in the direction of current flow between cathode and anode) for photocathode 170 and dynodes 160 . . . 167 will depend upon the material used and upon the desired detection wavelength but shall be in the range from 1 nm to less than 500 microns. Their widths (measured in the direction perpendicular to current flow between cathode and anode) shall be more than twice their lengths. The spacing between an adjacent photocathode, dynodes and/or anode is in the range of from 1 nanometer to about 10 millimeters.

Further optimized designs for specific applications including additional focusing electrodes, symetrical or asymmetrical dynode configurations to improve quantum efficiency, to optimize high gain or high speed are readily accommodated within the scope of this inventive concept. When a symetrical disposition of the dynodes is selected for the last embodiment, the aforedescribed stepped-configuration insulating interlayer is at a zero thickness thereby arriving at a planar geometry on which the interleaved conductive layers and insulating layers are stacked, i.e. the second embodiment disclosed above.

Obviously, many modifications and variations of the present invention are possible in the light of the above teachings. It is therefore to be understood that within the scope of the appended claims, the invention may be practiced otherwise than as specifically described.

I claim:

1. A method of fabricating a microelectronic photomultiplier device responsive to at least one impinging wavelength comprising:

providing an insulating substrate;

depositing an anode conductive layer forming an anode on said insulating substrate;

forming a stepped configuration insulating interlayer over said anode conductive layer;

depositing a stacked series of dynode conductive layers interleaved with insulating layers on said stepped configuration insulating interlayer, said stacked series of dynode conductive layers interleaved with insulating layers having a portion defining a stepped cross-sectional configuration;

etching-away said portion defining a stepped cross-sectional configuration to produce a cavity between separated columns of alternately staggered dynode conductive layers interleaved with insulating layers thereby exposing separated columns of alternately staggered dynodes and said anode;

evacuating any gas that may have been in said cavity to produce an evacuated cavity; and closing said evacuated cavity with a transparent substrate having a photocathode thereon to create an evacuated chamber in communication with said photocathode, said separated columns of alternately staggered dynodes and said anode, said photocathode having the property to generate a representative electron emission in response to said at least one impinging wavelength to thereby provide said microelectronic photomultiplier device.

2. A method according to claim 1 further including:

planarizing a top interleaved insulating layer to provide a substantially planarized top surface that coextends with the exposed top surface of the top interleaved dynode conductive layer prior to said closing said evacuated cavity with a transparent substrate.

3. A method according to claim 1 in which said etching-away is performed with an etchant having the property to etch-away said portion defining a stepped cross-sectional configuration.

4. A method according to claim 3 in which said etching includes isotropically etching the interleaved dynode conductive layers to slightly undercut the interleaved insulating layers to form the desired dynodes while anisotropically etching the interleaved insulating layers to form the vertical barriers desired for dielectric isolation between adjacent alternately staggered dynodes.

5. A method according to claim 4 further including:

filling said cavity with a sacrificial material prior to said closing of said cavity;

further-etching with an etchant having the property to etch-away said sacrificial material produces said cavity to produce said evacuated chamber after said closing thereof to assure a subsequent electron transport and amplification in said vacuum chamber along said staggered dynodes during operation of said microelectronic photomultiplier device.

6. A method according to claim 1 in which said closing said evacuated cavity is through wafer bonding said transparent substrate having a photocathode thereon to said insulating substrate containing said photocathode, said separated columns of alternately staggered dynodes and said anode in said evacuated cavity.

7. A method according to claim 2 in which said etching-away is performed with an etchant having the property to etch-away said portion defining a stepped cross-sectional configuration.

8. A method according to claim 7 in which said etching includes isotropically etching the interleaved dynode conductive layers to slightly undercut the interleaved insulating layers to form the desired dynodes while anisotropically etching the interleaved insulating layers to form the vertical barriers desired for dielectric isolation between adjacent alternately staggered dynodes.

9. A method according to claim 8 further including:

filling said cavity with a sacrificial material prior to said closing of said cavity;

further-etching with an etchant having the property to etch-away said sacrificial material produces said cavity to produce said evacuated chamber after said closing thereof to assure a subsequent electron transport and amplification in said vacuum chamber along said alternately staggered dynodes during operation of said microelectronic photomultiplier device.

10. A method according to claim 2 in which said closing said evacuated cavity is through wafer bonding said transparent substrate having a photocathode thereon to said insulating substrate thereby containing said photocathode, said separated columns of alternately staggered dynodes, said anode in said evacuated cavity.

11. A method according to claim 1 in which the etching-away is a reactive ion etching.

12. A method according to claim 1 in which the etching-away is a plasma etching.

13. A method according to claim 1 in which the etching-away is an ion milling.

14. A method according to claim 2 in which the etching-away is a reactive ion etching.

15. A method according to claim 2 in which the etching-away is a plasma etching.

16. A method according to claim 2 in which the etching-away is an ion milling.

17. A microelectronic photomultiplier device responsive to at least one impinging wavelength including:

an insulating substrate;

a conductive layer anode forming an anode disposed on said insulating substrate;

a stepped configuration insulating interlayer disposed on said conductive layer anode;

a pair of columns of stacked series of dynode conductive layers interleaved with insulating layers disposed on said stepped configuration insulating interlayer, said pair of columns of stacked series of dynode conductive layers interleaved with insulating layers arranged to provide alternatively staggered dynodes and to define a cavity in communication with said alternately staggered dynodes and said anode in a separation between adjacent said alternately staggered dynodes and said anode of between 1 micron and 10 millimeters;

an evacuated cavity defined within the stepped cross-sectional configuration to produce separated columns of alternately staggered dynode conductive layers interleaved with insulating layers thereby exposing separated columns of alternately staggered dynodes;

a transparent substrate disposed on said pair of columns of stacked series of dynode conductive layers interleaved with insulating layers and across said cavity to define a cavity-chamber therein;

a photocathode disposed on said transparent substrate in said cavity-chamber, said photocathode having the property to generate a representative electron emission in response to said at least one impinging wavelength and being spaced from an adjacent one of said dynodes between 1 micron to 10 millimeters to thereby provide said microelectronic photomultiplier device.

18. An apparatus according to claim 17 where the thicknesses for photocathode, anode and dynodes are in the range from 1 nm to 500 microns.

19. An apparatus according to claim 17 where the lengths for the photocathode, anode and dynodes are in the range from 1 micron to 10 millimeters.

20. An apparatus according to claim 17 where the width for the photocathode, anode and dynodes shall be more than twice their lengths.

21. A method of fabricating a microelectronic photomultiplier device responsive to at least one impinging wavelength comprising:

providing an insulating substrate;

depositing an anode conductive layer forming an anode on said insulating substrate;

forming a planar configuration insulating layer over said anode conductive layer;

depositing a stacked series of dynode conductive layers interleaved with insulating layers on said planar configuration insulating layer, said stacked series of dynode conductive layers interleaved with insulating layers defining a paired conductive-layer-insulating-layer multilayer structure;

etching-away a portion of said paired conductive-layer-insulating-layer multilayer structure to produce a cavity between separated columns of said paired conductive-layer-insulating-layer multilayer structure thereby exposing separated columns of spaced apart dynodes and said anode;

evacuating any gas that may have been in said cavity to produce an evacuated cavity; and closing said evacuated cavity with a transparent substrate having a photocathode thereon to create an evacuated chamber in communication with said photocathode, said separated columns of spaced apart dynodes and said anode, said photocathode having the property to generate a representative electron emission in response to said at least one impinging wavelength to thereby provide said microelectronic photomultiplier device.

22. A method according to claim 21 in which said etching-away is performed with an etchant having the property to etch-away said portion.

23. A method according to claim 22 further including:

filling said cavity with a sacrificial material prior to said closing of said cavity;

further-etching with an etchant having the property to etch-away said sacrificial material produces said cavity to produce said evacuated chamber after said closing thereof to assure a subsequent electron transport and amplification in said vacuum chamber along said spaced apart dynodes during operation of said microelectronic photomultiplier device.

24. A method according to claim 21 in which said closing said evacuated cavity is through wafer bonding said transparent substrate having a photocathode thereon to said insulating substrate containing said photocathode, said separated columns of spaced apart dynodes and said anode in said evacuated cavity.

25. A method according to claim 21 in which said etching-away is performed with an etchant having the property to etch-away said portion.

26. A method according to claim 25 in which said etching includes isotropically etching the interleaved dynode conductive layers to slightly undercut the interleaved insulating layers to form the desired dynodes while anisotropically etching the interleaved insulating layers to form the vertical barriers desired for dielectric isolation between adjacent spaced apart dynodes.

27. A method according to claim 26 further including:

filling said cavity with a sacrificial material prior to said closing of said cavity;

further-etching with an etchant having the property to etch-away said sacrificial material produces said cavity to produce said evacuated chamber after said closing thereof to assure a subsequent electron transport and amplification in said vacuum chamber along said spaced apart dynodes during operation of said microelectronic photomultiplier device.

28. A method according to claim 21 in which said closing said evacuated cavity is through wafer bonding said transparent substrate having a photocathode thereon to said insulating substrate thereby containing said photocathode, said separated columns of spaced apart dynodes, said anode in said evacuated cavity.

29. A method according to claim 21 in which the etching-away is a reactive ion etching.

30. A method according to claim 21 in which the etching-away is a plasma etching.

31. A method according to claim 21 in which the etching-away is an ion milling.

32. A microelectronic photomultiplier device responsive to at least one impinging wavelength including:

an insulating substrate;

a conductive layer anode forming an anode disposed on said insulating substrate;

a planar configuration insulating layer disposed on said conductive layer anode;

a pair of columns of a stacked series of dynode conductive layers interleaved with insulating layers disposed on said planar configuration insulating layer, said pair of columns of stacked series of dynode conductive layers interleaved with insulating layers arranged to provide spaced apart dynodes and to define a cavity in communication with said spaced apart dynodes and said anode in a separation between adjacent said spaced apart dynodes and said anode of between 1 micron and 10 millimeters;

an evacuated cavity defined within said pair of colunmns of a stacked series of dynode conductive layers interleaved with insulating layers to produce separated columns of spaced apart dynode conductive layers interleaved with insulating layers thereby exposing separated columns of spaced apart dynodes;

a transparent substrate disposed on said pair of columns of stacked series of dynode conductive layers interleaved with insulating layers and across said cavity to define a cavity-chamber therein;

a photocathode disposed on said transparent substrate in said cavity-chamber, said photocathode having the property to generate a representative electron emission in response to said at least one impinging wavelength and being spaced from an adjacent one of said dynodes between 1 micron to 10 millimeters to thereby provide said microelectronic photomultiplier device.

33. An apparatus according to claim 28 where the thicknesses for photocathode, anode and dynodes are in the range from 1 nm to 500 microns.

34. An apparatus according to claim 28 where the lengths for the photocathode, anode and dynodes are in the range from 1 micron to 10 millimeters.

35. An apparatus according to claim 28 where the width for the photocathode, anode and dynodes shall be more than twice their lengths.

* * * * *